US007259727B2

(12) United States Patent
Chan

(10) Patent No.: US 7,259,727 B2
(45) Date of Patent: Aug. 21, 2007

(54) ANTENNA MOUNTING DEVICE

(75) Inventor: Yat To Chan, Tauyuan Hsien (TW)

(73) Assignee: Joymax Electronics Co., Ltd., Chongli Gonyeh Chu, Chongli Tauyuan Hsien (TW)

( * ) Notice: Subject to any disclaimer, the term of this patent is extended or adjusted under 35 U.S.C. 154(b) by 26 days.

(21) Appl. No.: 11/338,940

(22) Filed: Jan. 25, 2006

(65) Prior Publication Data

US 2007/0171141 A1 Jul. 26, 2007

(51) Int. Cl.
*H01Q 1/12* (2006.01)
*H01Q 1/32* (2006.01)

(52) U.S. Cl. ..... 343/888; 343/715; 343/906

(58) Field of Classification Search ..... 343/888, 343/878, 880, 882, 713, 711, 715, 906
See application file for complete search history.

(56) References Cited

U.S. PATENT DOCUMENTS 5,032,846 A * 7/1991 Chang ..... 343/882
6,023,218 A 2/2000 Tremblay ..... 340/425.5
6,469,678 B1 * 10/2002 Pullen ..... 343/888
6,486,842 B2 * 11/2002 Wang ..... 343/715
6,714,171 B2 * 3/2004 Haussler et al. ..... 343/888
6,791,501 B2 9/2004 Maeda et al. ..... 343/715

* cited by examiner

*Primary Examiner*—Hoanganh Le

(57) ABSTRACT

An antenna mounting device includes a housing having a chamber formed by an outer peripheral wall, a suction cup and a base casing received in the housing, the base casing includes a lower seat and an upper seat disposed on top of an outer peripheral fence, a ring member is rotatably engaged onto the base casing and includes a bottom actuator and a recessed actuator for engaging with the lower seat and the upper seat of the base casing and for adjusting the ring member up and down relative to the base casing when the ring member is rotated relative to the base casing. A cap is coupled to the central coupling member of the suction cup with a stem for actuating the suction cup.

10 Claims, 7 Drawing Sheets

ANTENNA MOUNTING DEVICE

BACKGROUND OF THE INVENTION

1. Field of the Invention

The present invention relates to an antenna mounting device, and more particularly to an antenna mounting device having a structure for easily and readily attaching an antenna member to various supporting facilities, such as wall members, window glasses, vehicle roofs, etc.

2. Description of the Prior Art

Typical antenna devices are required to be attached or mounted onto various supporting facilities, such as wall members, window glasses, vehicle roofs, etc. and comprise a radio frequency receiver for receiving signals, and a securing means having a felt covered attachment magnet for securing or attaching the antenna devices onto the supporting facilities.

For example, U.S. Pat. No. 6,023,218 to Tremblay discloses one of the typical antenna devices also comprising a felt covered attachment magnet secured within a bottom of an antenna supporting housing for securing or attaching the antenna supporting housing to metallic supporting facilities.

However, the magnet may be used for securing or attaching the antenna supporting housing to metallic supporting facilities only, and the metallic supporting facilities should include a smooth outer surface for allowing the magnet to be stably or solidly secured or attached onto the metallic supporting facilities.

U.S. Pat. No. 6,791,501 to Maeda et al. discloses another typical vehicle roof mount antenna comprising an antenna base for attaching onto various supporting facilities. However, the antenna base includes a power supply cord that is required to be engaged through the typical vehicle roof; i.e., the typical vehicle roof is required to be drilled with a hole for receiving or engaging the power supply cord, such that the typical vehicle roof mount antenna may not be easily secured or attached onto the supporting facilities, particularly the vehicles by themselves.

The present invention has arisen to mitigate and/or obviate the afore-described disadvantages of the conventional antenna mounting devices.

SUMMARY OF THE INVENTION

The primary objective of the present invention is to provide an antenna mounting device including a structure for easily and readily attaching an antenna member to various supporting facilities, such as wall members, window glasses, vehicle roofs, etc.

In accordance with one aspect of the invention, there is provided a antenna mounting device comprising a housing including a chamber formed therein and defined by an outer peripheral wall, a suction cup received in the chamber of the housing and including an outer peripheral skirt and a central coupling member, a base casing received in the chamber of the housing and disposed above the suction cup, the base casing including an outer peripheral flange engaged onto the outer peripheral skirt of the suction cup for pressing and positioning the outer peripheral skirt of the suction cup, the base casing including a compartment formed and defined by an outer peripheral fence for receiving the central coupling member of the suction cup, the base casing including a lower seat and an upper seat provided on top of the outer peripheral fence, a ring member rotatably engaged onto the base casing and including a bottom actuator and a recessed actuator provided in a bottom portion for engaging with the lower seat and the upper seat of the base casing and for moving and adjusting the ring member up and down relative to the base casing when the ring member is rotated relative to the base casing, a cap engaged onto the ring member, and a stem secured between the cap and the central coupling member of the suction cup for allowing the central coupling member of the suction cup to be moved downwardly and pulled upwardly by the cap and the stem when the ring member is rotated relative to the base casing, in order to selectively release and actuate the suction cup.

The base casing includes at least one rib extended outwardly from the outer peripheral fence, and the housing includes at least one groove formed therein for receiving the rib of the base casing and for anchoring and positioning the base casing to the housing and for preventing the base casing from being rotated relative to the housing.

The housing includes a recessed channel formed in an upper portion of the outer peripheral wall and defined between two end stops, and the ring member includes a knob slidably engaged in the recessed channel of the outer peripheral wall and engageable with the stops for limiting the knob and the ring member to rotate relative to the housing.

The ring member includes a bore, the cap includes a shank engaged into the bore of the ring member and includes a peripheral flange extended radially and outwardly from the shank and engaged with the ring member for anchoring the cap to the ring member and for allowing the cap and the ring member to be moved up and down in concert with each other.

The cap includes a bore formed therein, a peripheral bulge extended into the bore of the cap, and a fastener engaged with the peripheral bulge of the cap and secured to the stem for securing the stem to the cap, and thus for allowing the cap and the stem to be moved up and down relative to the housing by the ring member, in order to actuate the suction cup.

A magnetic member is received in the chamber of the housing and disposed around the suction cup and secured to the housing for magnetically attracting and securing the housing to metallic supporting facility.

The housing includes a base panel for engaging onto a supporting facility, and the base panel includes at least one aperture for securing onto the supporting facility. The base panel includes at least one key hole for hanging to the supporting facility.

The housing includes two opposite side brackets oppositely extended from the outer peripheral wall, and a frame includes two end portions rotatably secured to the brackets of the housing with fasteners for allowing the frame to be adjustably rotated relative to the housing and selectively secured to the housing at selected angular position. The frame may include one or more holes for attaching various electric members.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
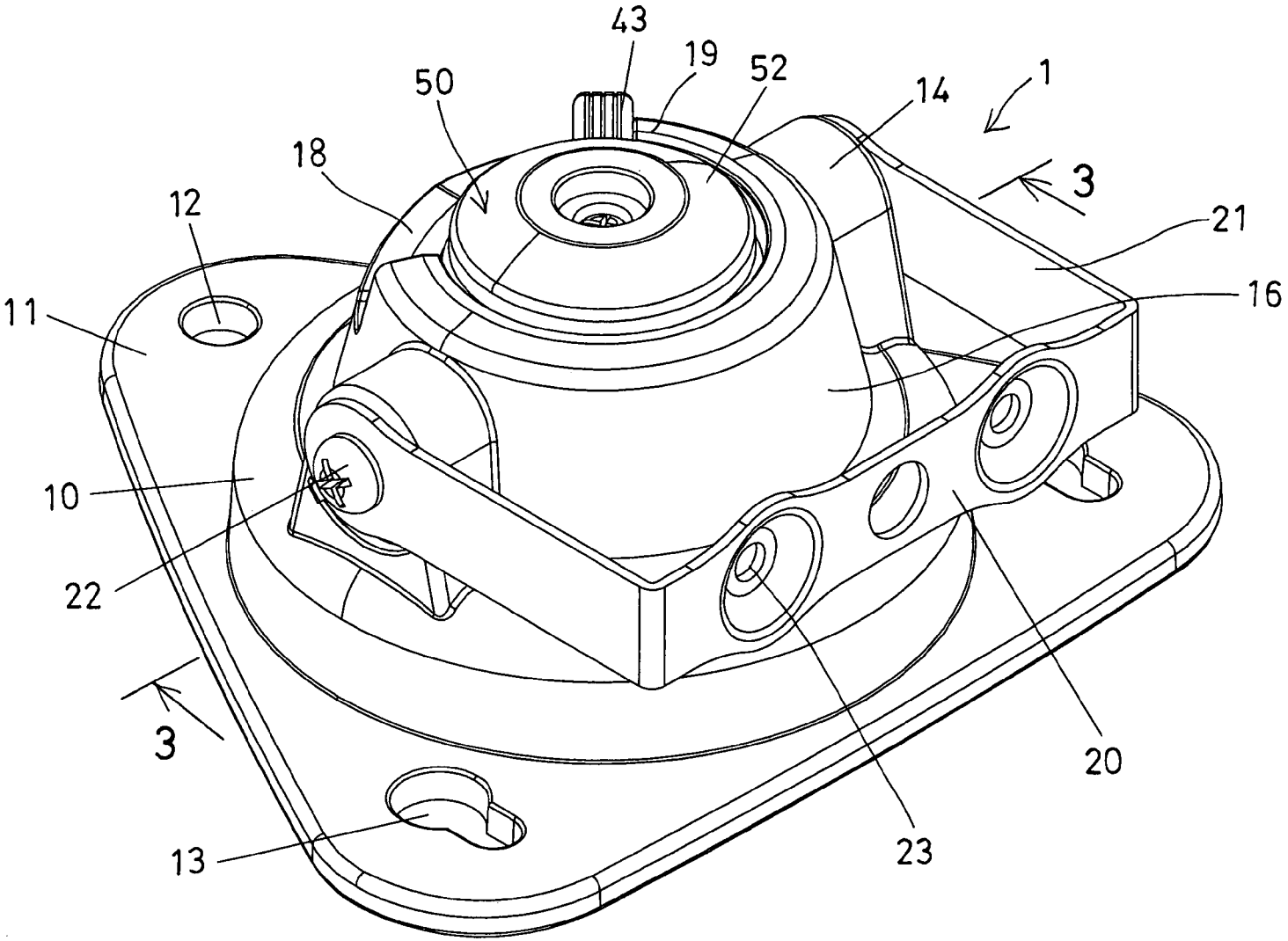
FIG. 1 is a perspective view of an antenna mounting device in accordance with the present invention.
Figure 2:
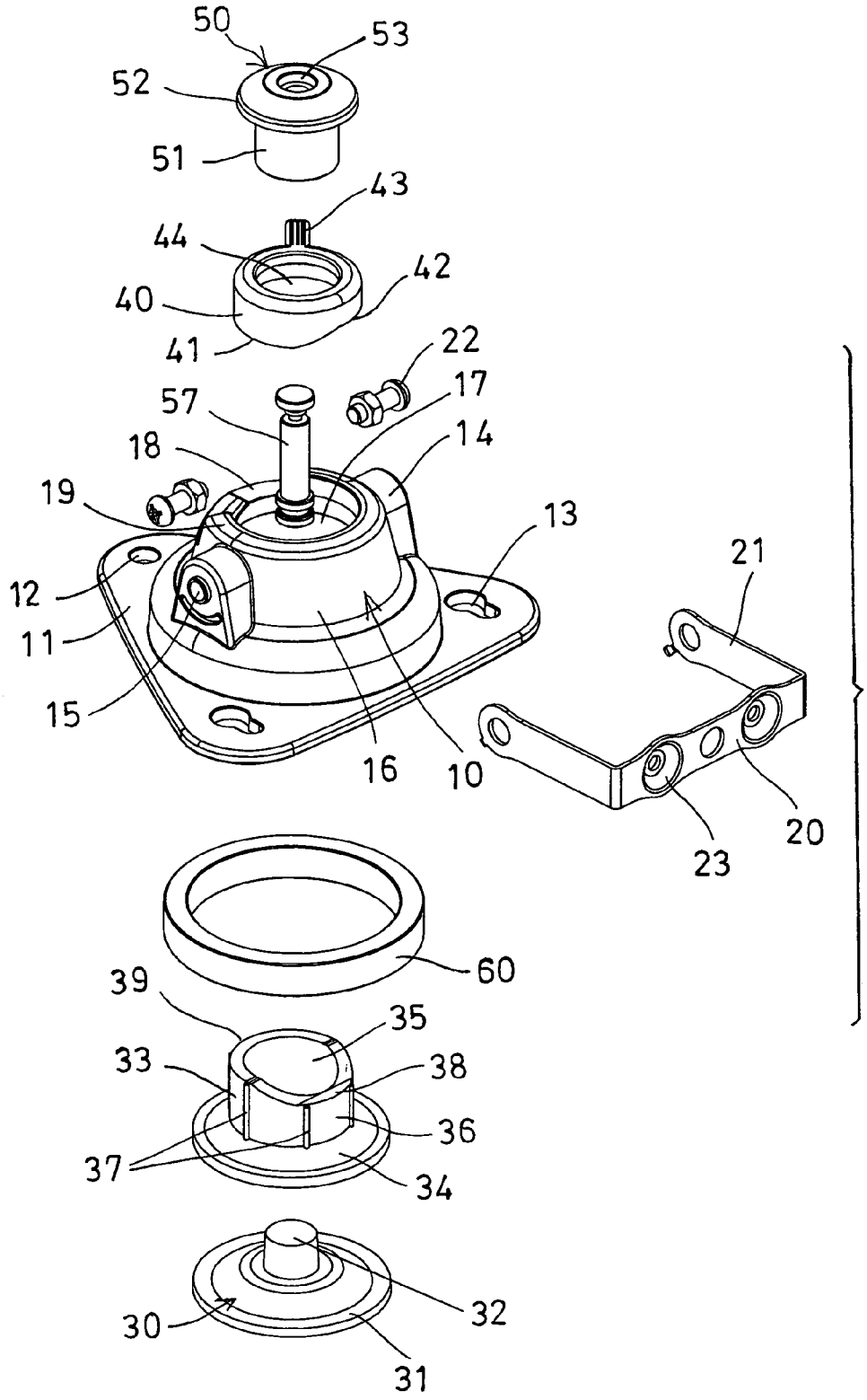
FIG. 2 is an exploded view of the antenna mounting device.

Referring to the drawings, and initially to FIGS. 1-4, an antenna mounting device in accordance with the present invention comprises a housing 10 including a base panel 11 for attaching or engaging onto various supporting facilities, such as wall members, window glasses, vehicle roofs, etc., and the base panel 11 includes one or more apertures 12 and/or one or more key holes 13 formed therein for securing or hanging onto the supporting facilities with such as fasteners, pegs, etc.

The housing 10 includes two opposite side brackets 14 each having a screw hole 15 formed therein, and includes an outer peripheral wall 16 having the brackets 14 oppositely formed or provided or extended from the outer peripheral wall 16, and includes a chamber 17 formed in the housing 10 and defined by the outer peripheral wall 16. The outer peripheral wall 16 includes a recessed channel 18 formed in the upper portion of the outer peripheral wall 16 and defined between two end shoulders or stops 19, and extended for about one quarter of the outer peripheral wall 16.

Figure 7:
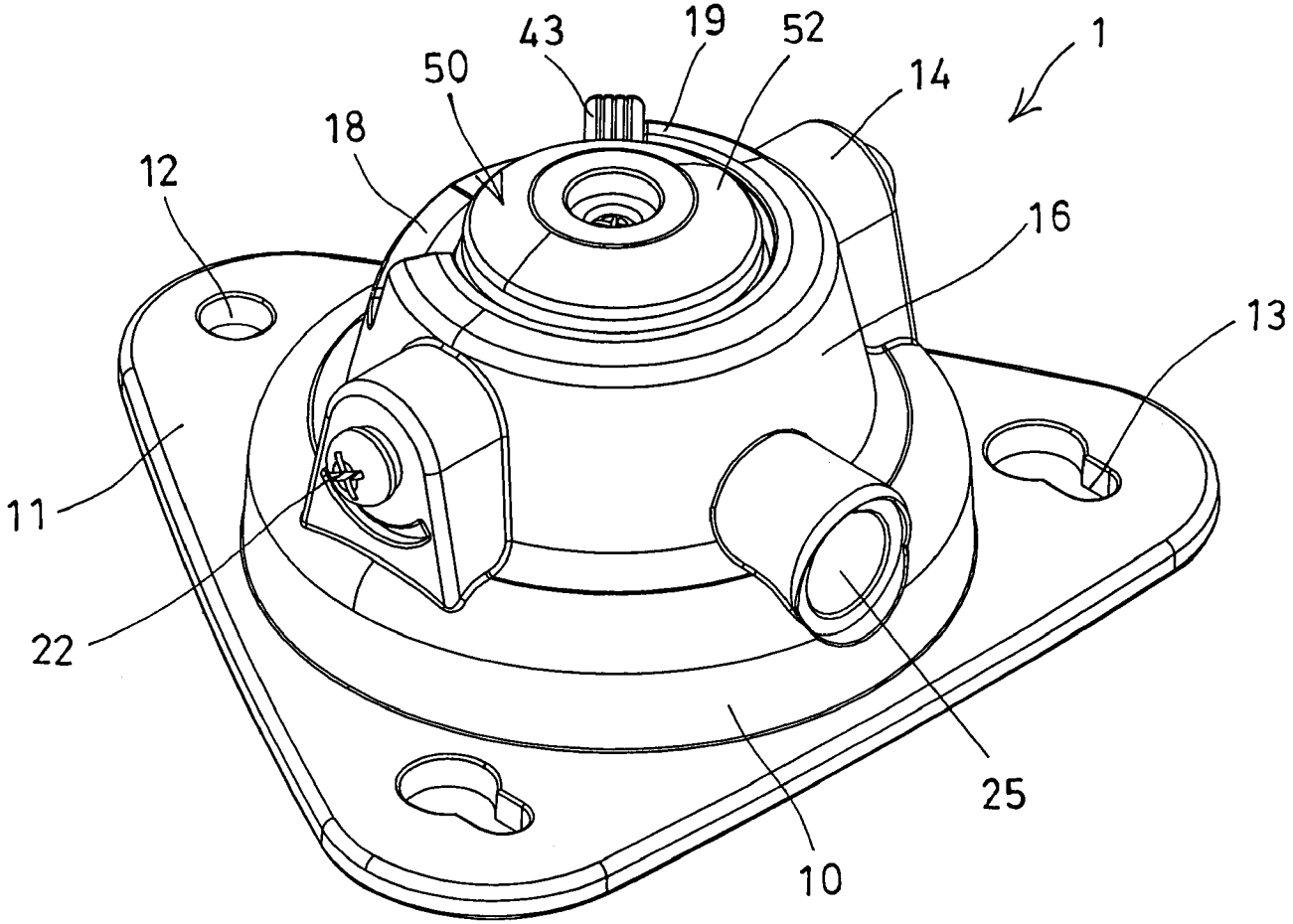
FIG. 7 is a perspective view similar to FIG. 1, illustrating the other arrangement of the antenna mounting device.

A U-shaped frame 20 includes two end portions 21 engageable with the brackets 14 of the housing 10 and rotatably secured to the brackets 14 of the housing 10 with such as fasteners 22, for allowing the frame 20 to be adjustably rotated relative to the housing 10 and selectively secured to the housing 10 at selected angular position. The frame 20 includes one or more holes 23 formed therein for attaching various members, such as antenna (not shown), or the like. Alternatively, as shown in FIG. 7, the housing 10 may include one or more outwardly extended tubes 25 for attaching the antenna members or the like.

A suction cup 30 is received in the chamber 17 of the housing 10 and disposed in the bottom portion of the housing 10 and includes an outer peripheral skirt 31, and includes a central coupling member 32. A base casing 33 is also received in the chamber 17 of the housing 10 and disposed above the suction cup 30 and includes an outer peripheral flange 34 engaged onto the outer peripheral skirt 31 of the suction cup 30 for pressing and anchoring or positioning the outer peripheral skirt 31 of the suction cup 30 onto the supporting facilities, and includes a compartment 35 formed therein and defined by an outer peripheral fence 36 for receiving the central coupling member 32 and the central portion of the suction cup 30.

The base casing 33 includes one or more keys or ribs 37 extended outwardly from the outer peripheral fence 36 thereof, and the housing 10 includes one or more grooves 27 formed therein (FIGS. 3, 5) for receiving the keys or ribs 37 of the base casing 33 and for anchoring or positioning the base casing 33 to the housing 10 and for preventing the base casing 33 from being rotated relative to the housing 10. The base casing 33 includes a lower seat 38 and an upper seat 39 formed or provided on top of the outer peripheral fence 36 and preferably arranged opposite to each other.

Figure 3:
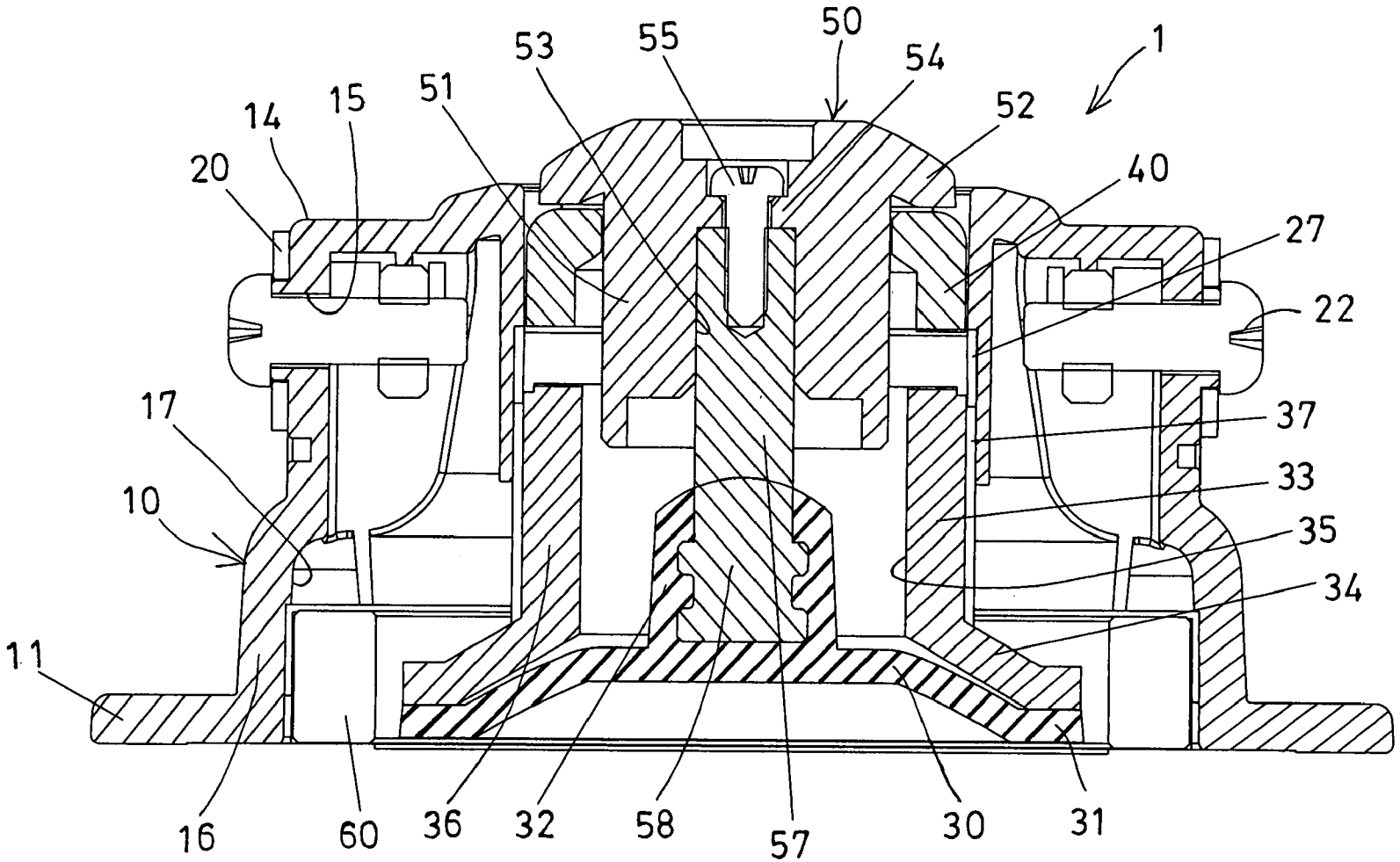
FIG. 3 is a cross sectional view of the antenna mounting device taken along lines 3-3 of FIG. 1.
Figure 4:
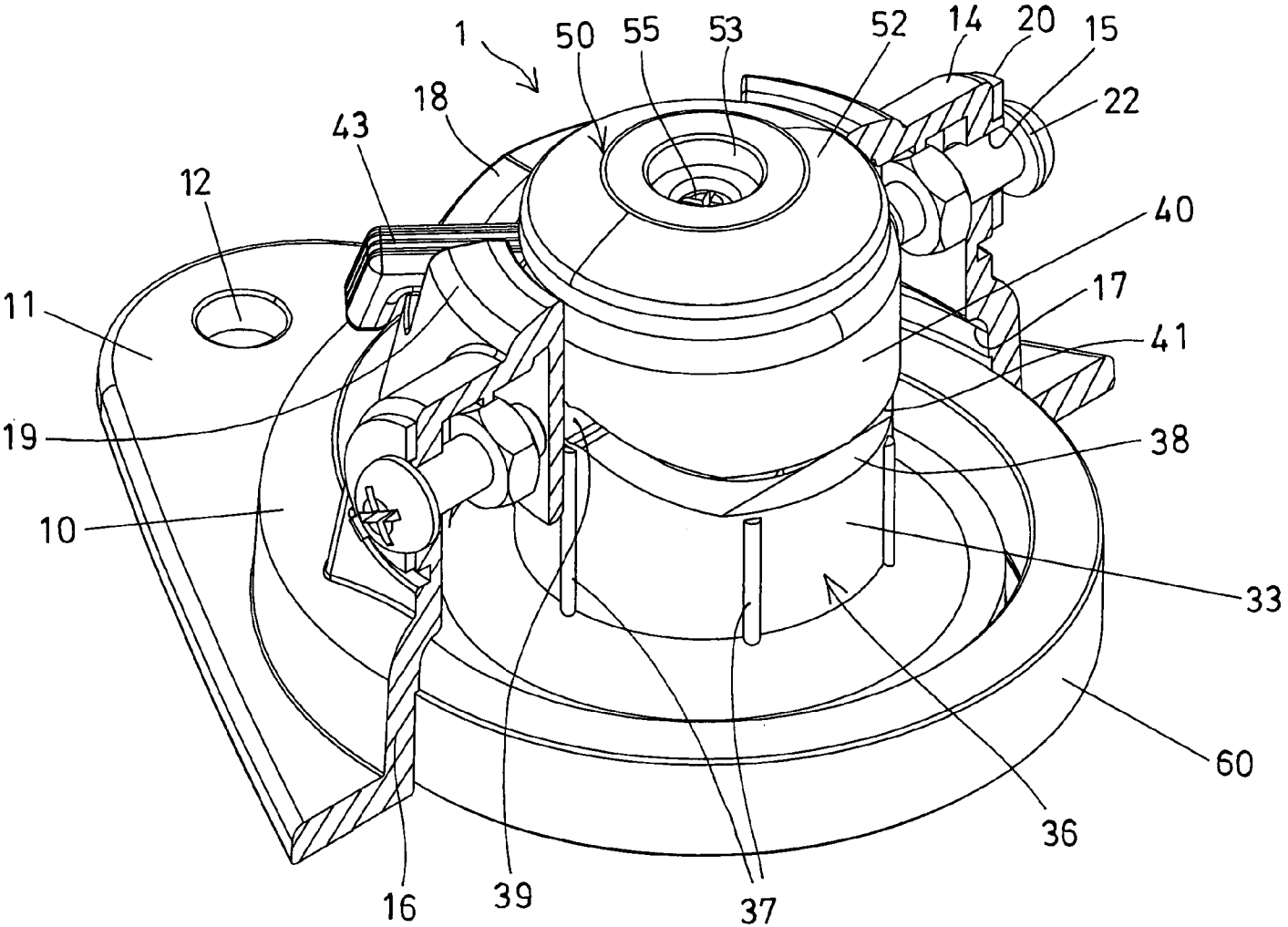
FIG. 4 is a perspective view of the antenna mounting device, in which a portion of the antenna mounting device has been cut off for showing an inner structure of the antenna mounting device.

A ring member 40 is rotatably engaged onto the base casing 33 and includes a lower or bottom actuator 41 and a recessed or upper actuator 42 formed or provided in the bottom portion thereof and preferably also arranged opposite to each other for engaging with the lower seat 38 and the upper seat 39 of the base casing 33 and thus for moving or adjusting the ring member 40 up and down relative to the base casing 33, best shown in FIGS. 3-4 (closer position) and 5-6 (spaced away from each other).

Figure 5:
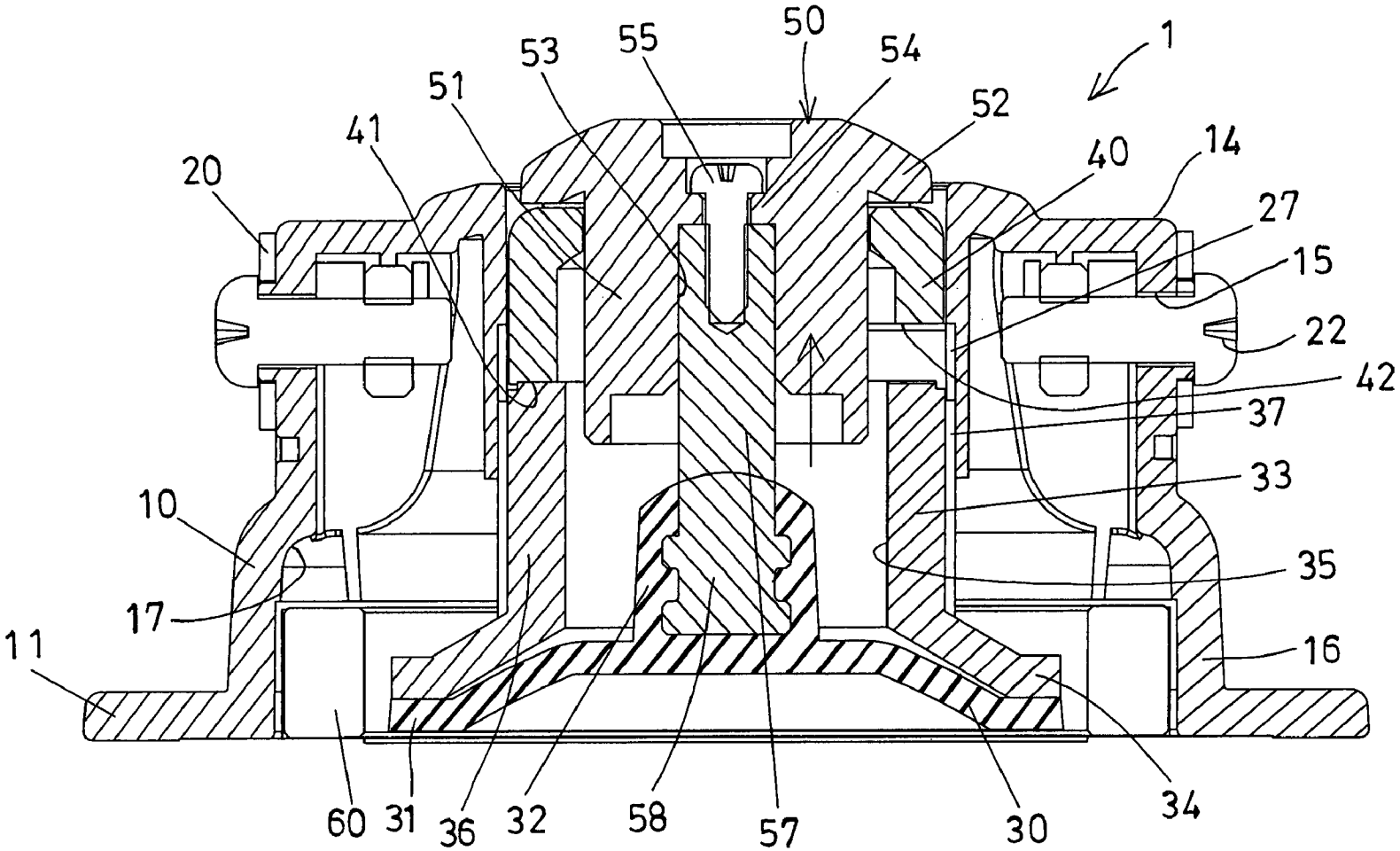
FIG. 5 is a cross sectional view similar to FIG. 3, illustrating the operation of the antenna mounting device.
Figure 6:
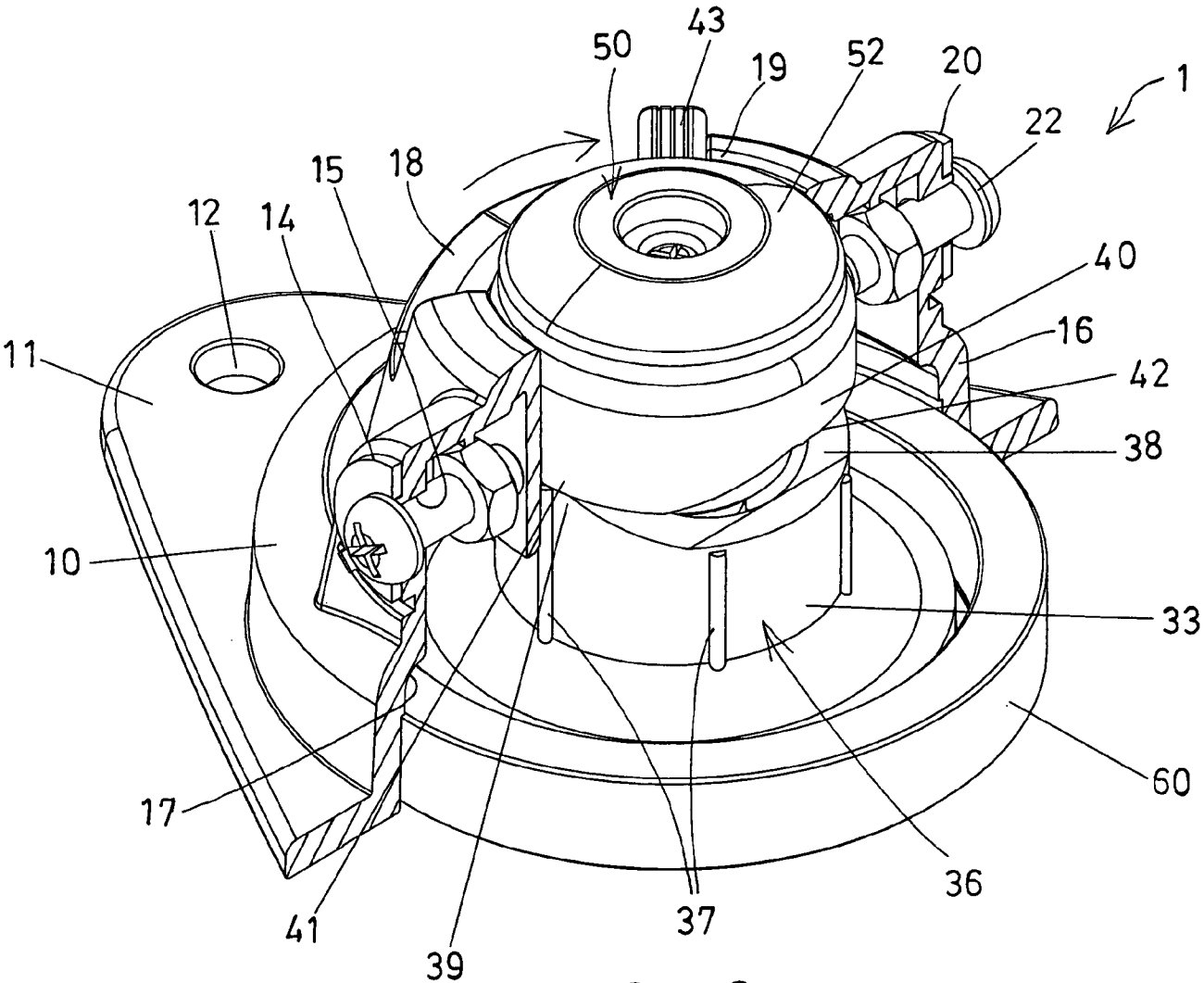
FIG. 6 is a perspective view similar to FIG. 4, illustrating the operation of the antenna mounting device.

For example, as shown in FIGS. 3-4, the bottom actuator 41 and the recessed upper actuator 42 of the ring member 40 are engaged with the lower seat 38 and the upper seat 39 of the base casing 33 respectively for allowing the ring member 40 to be moved downwardly toward and closer to the base casing 33. As shown in FIGS. 5-6, the bottom actuator 41 of the ring member 40 is engaged with the upper seat 39 of the base casing 33 for allowing the recessed upper actuator 42 of the ring member 40 to be spaced away from the lower seat 38 of the base casing 33 when the ring member 40 is rotated relative to the base casing 33 and the housing 10.

The ring member 40 includes a knob 43 extended therefrom and slidably engaged in the recessed channel 18 of the outer peripheral wall 16 and engageable with the stops 19 which may limit the knob 43 and thus the ring member 40 to rotate relative to the housing 10, and which may also be used to maintain the bottom actuator 41 of the ring member 40 in engagement with either the lower seat 38 of the base casing 33 (FIGS. 3-4) or the upper seat 39 of the base casing 33 (FIGS. 5-6).

A cap 50 includes a shank 51 engaged into a bore 44 of the ring member 40, and includes a peripheral flange 52 extended radially and outwardly from the shank 51 and engaged with or onto the ring member 40 for anchoring the cap 50 to the ring member 40 and for allowing the cap 50 and the ring member 40 to be moved up and down in concert with each other. The cap 50 includes a bore 53 formed therein, and a peripheral bulge 54 extended into the bore 53 thereof for anchoring or engaging with a fastener 55. A stem 57 may be engaged into the bore 53 of the cap 50 and secured to the cap 50 with the fastener 55, and includes a lower end 58 secured and coupled to the central coupling member 32 of the suction cup 30 (FIGS. 3 and 5).

It is to be noted that the central coupling member 32 of the suction cup 30 is secured and coupled to the cap 50 with the fastener 55 and the stem 57, and the cap 50 is engaged with or onto the ring member 40 and will be moved up and down in concert with the ring member 40 such that the suction cup 30 may be moved downwardly and/or pulled upwardly relative to the base casing 33 and the housing 10 by rotating the ring member 40 relative to the housing 10 and by changing the bottom actuator 41 of the ring member 40 in engagement with either the lower seat 38 of the base casing 33 or the upper seat 39 of the base casing 33.

In operation, as shown in FIGS. 3 and 4, when the bottom actuator 41 and the recessed upper actuator 42 of the ring member 40 are engaged with the lower seat 38 and the upper seat 39 of the base casing 33 respectively, the ring member 40 and thus the cap 50 and the stem 57 may be moved downwardly toward and closer to the base casing 33 for releasing the suction cup 30. The suction cup 30 and the housing 10 may be engaged onto various supporting facilities such as wall members, window glasses, vehicle roofs, or other planar surfaces of various objects.

When the knob 43 of the ring member 40 is slid or moved along the recessed channel 18 of the outer peripheral wall 16 of the housing 10 or when the ring member 40 is rotated relative to the base casing 33 and the housing 10, as shown in FIGS. 5 and 6, the bottom actuator 41 of the ring member 40 may be moved or forced to engage with the upper seat 39 of the base casing 33 and the recessed upper actuator 42 of the ring member 40 may be spaced away from the lower seat 38 of the base casing 33; i.e., the ring member 40 and thus the cap 50 and the stem 57 may be moved upwardly away from the base casing 33 to pull the central coupling member 32 and the central portion of the suction cup 30 upwardly and thus to solidly secure the suction cup 30 and thus the housing 10 onto the supporting facilities.

A magnetic member 60 may further be provided and received and disposed in the chamber 17 of the housing 10 and secured to the bottom portion of the housing 10 and arranged around the suction cup 30 and the outer peripheral flange 34 of the base casing 33 for selectively and magnetically attracting and securing the housing 10 to various metallic supporting facilities, such as vehicle roofs or the like, for easily and readily attaching the antenna member to the metallic supporting facilities.

Accordingly, the antenna mounting device in accordance with the present invention includes a structure for easily and readily attaching an antenna member to various supporting facilities, such as wall members, window glasses, vehicle roofs, etc.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna mounting device comprising:

a housing including a chamber formed therein and defined by an outer peripheral wall, a suction cup received in said chamber of said housing and including an outer peripheral skirt and a central coupling member, a base casing received in said chamber of said housing and disposed above said suction cup, said base casing including an outer peripheral flange engaged onto said outer peripheral skirt of said suction cup for pressing and positioning said outer peripheral skirt of said suction cup, said base casing including a compartment formed and defined by an outer peripheral fence for receiving said central coupling member of said suction cup, said base casing including a lower seat and an upper seat provided on top of said outer peripheral fence, a ring member rotatably engaged onto said base casing and including a bottom actuator and a recessed actuator provided in a bottom portion for engaging with said lower seat and said upper seat of said base casing and for moving and adjusting said ring member up and down relative to said base casing when said ring member is rotated relative to said base casing, a cap engaged onto said ring member, and a stem secured between said cap and said central coupling member of said suction cup for allowing said central coupling member of said suction cup to be moved downwardly and pulled upwardly by said cap and said stem when said ring member is rotated relative to said base casing, in order to selectively release and actuate said suction cup.

2. The antenna mounting device as claimed in claim 1, wherein said base casing includes at least one rib extended outwardly from said outer peripheral fence, and said housing includes at least one groove formed therein for receiving said at least one rib of said base casing and for anchoring and positioning said base casing to said housing and for preventing said base casing from being rotated relative to said housing.

3. The antenna mounting device as claimed in claim 1, wherein said housing includes a recessed channel formed in an upper portion of said outer peripheral wall and defined between two end stops, and said ring member includes a knob slidably engaged in said recessed channel of said outer peripheral wall and engageable with said stops for limiting said knob and said ring member to rotate relative to said housing.

4. The antenna mounting device as claimed in claim 1, wherein said ring member includes a bore, said cap includes a shank engaged into said bore of said ring member and includes a peripheral flange extended radially and outwardly from said shank and engaged with said ring member for anchoring said cap to said ring member and for allowing said cap and said ring member to be moved up and down in concert with each other.

5. The antenna mounting device as claimed in claim 1, wherein said cap includes a bore formed therein, a peripheral bulge extended into said bore of said cap, and a fastener engaged with said peripheral bulge of said cap and secured to said stem for securing said stem to said cap.

6. The antenna mounting device as claimed in claim 1, wherein a magnetic member is received in said chamber of said housing and disposed around said suction cup and secured to said housing for magnetically attracting and securing said housing to metallic supporting facility.

7. The antenna mounting device as claimed in claim 1, wherein said housing includes a base panel for engaging onto a supporting facility, and said base panel includes at least one aperture for securing onto the supporting facility.

8. The antenna mounting device as claimed in claim 7, wherein said base panel includes at least one key hole for hanging to the supporting facility.

9. The antenna mounting device as claimed in claim 1, wherein said housing includes two opposite side brackets oppositely extended from said outer peripheral wall, and a frame includes two end portions rotatably secured to said brackets of said housing with fasteners for allowing said frame to be adjustably rotated relative to said housing and selectively secured to said housing at selected angular position.

10. The antenna mounting device as claimed in claim 9, wherein said frame includes at least one hole formed therein for attaching various members.

* * * * *